US008823628B2

(12) United States Patent
Chung

(10) Patent No.: US 8,823,628 B2
(45) Date of Patent: Sep. 2, 2014

(54) SCAN DRIVING CIRCUIT AND DISPLAY APPARATUS USING THE SAME

(75) Inventor: Bo-Yong Chung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 314 days.

(21) Appl. No.: 12/986,977

(22) Filed: Jan. 7, 2011

(65) Prior Publication Data

US 2011/0273421 A1 Nov. 10, 2011

(30) Foreign Application Priority Data

May 6, 2010 (KR) ..... 10-2010-0042582

(51) Int. Cl.
*G09G 3/36* (2006.01)

(52) U.S. Cl.
USPC ..... 345/100; 345/204

(58) Field of Classification Search
None
See application file for complete search history.

(56) References Cited

U.S. PATENT DOCUMENTS

| | | | | |
|---|---|---|---|---|
| 2004/0174189 | A1* | 9/2004 | Nagao et al. | 326/97 |
| 2004/0187046 | A1* | 9/2004 | Lee et al. | 713/500 |
| 2004/0207315 | A1* | 10/2004 | Robbie et al. | 313/504 |
| 2005/0018807 | A1* | 1/2005 | Han et al. | 377/69 |
| 2005/0036581 | A1* | 2/2005 | Lin | 377/54 |
| 2005/0052141 | A1* | 3/2005 | Thielemans et al. | 315/169.3 |
| 2005/0212746 | A1* | 9/2005 | Iwasaki et al. | 345/100 |
| 2006/0001637 | A1* | 1/2006 | Pak et al. | 345/100 |
| 2006/0145964 | A1* | 7/2006 | Park et al. | 345/76 |
| 2006/0145998 | A1* | 7/2006 | Cho et al. | 345/100 |
| 2006/0227094 | A1* | 10/2006 | Park et al. | 345/100 |
| 2006/0284815 | A1* | 12/2006 | Kwon et al. | 345/98 |
| 2007/0001990 | A1* | 1/2007 | Lee et al. | 345/100 |
| 2007/0018918 | A1* | 1/2007 | Chung | 345/76 |
| 2007/0046608 | A1* | 3/2007 | Chung | 345/92 |
| 2007/0063933 | A1* | 3/2007 | Chung | 345/76 |
| 2007/0085811 | A1* | 4/2007 | Lee | 345/100 |
| 2007/0183218 | A1* | 8/2007 | Lee et al. | 365/185.26 |
| 2007/0296676 | A1* | 12/2007 | Moon et al. | 345/98 |
| 2008/0062113 | A1 | 3/2008 | Kim | |
| 2008/0074359 | A1* | 3/2008 | Chung | 345/76 |
| 2008/0189568 | A1* | 8/2008 | Kwak | 713/501 |
| 2008/0266477 | A1* | 10/2008 | Lee et al. | 349/46 |
| 2009/0040161 | A1* | 2/2009 | Baek et al. | 345/94 |
| 2009/0091523 | A1* | 4/2009 | Fujita et al. | 345/87 |

FOREIGN PATENT DOCUMENTS

| | | | |
|---|---|---|---|
| JP | 2005-062397 | A | 3/2005 |
| KR | 10-0667075 | | 1/2007 |
| KR | 10-2007-0019490 | | 2/2007 |
| KR | 10-2007-0121968 | | 12/2007 |
| KR | 10-2008-0000850 | | 1/2008 |
| KR | 10-2008-0022638 | A | 3/2008 |
| KR | 10-2008-0033630 | A | 4/2008 |

OTHER PUBLICATIONS

KIPO Registration Determination Certificate dated Nov. 17, 2011 for KR 10-2010-0042582 (5 pages).

* cited by examiner

*Primary Examiner* — Amare Mengistu
*Assistant Examiner* — Antonio Xavier
(74) *Attorney, Agent, or Firm* — Christie, Parker & Hale, LLP

(57) ABSTRACT

A scan driving circuit that generates a plurality of scan signals overlapping with each other by h horizontal cycles, that is driven by using (2h+2) clock signals, and that includes a small number of transistors, where h denotes a natural number less than or equal to n−1 and n is an integer greater than "4."

17 Claims, 7 Drawing Sheets

SCAN DRIVING CIRCUIT AND DISPLAY APPARATUS USING THE SAME

CROSS-REFERENCE TO RELATED APPLICATION

This application claims priority to and the benefit of Korean Patent Application No. 10-2010-0042582, filed on May 6, 2010, in the Korean Intellectual Property Office, the entire content of which is incorporated herein in its entirety by reference.

BACKGROUND

1. Field

One or more embodiments of the present invention relate to a scan driving circuit, and more particularly, to a display apparatus using the same.

2. Description of Related Art

A display apparatus transforms input data into an image and provides the image to a user by applying a data signal corresponding to the input data to a plurality of pixel circuits so as to adjust brightness of each of a plurality of pixels. A scan driving circuit generates a scan signal for selecting a pixel and outputs the scan signal to select the pixel.

SUMMARY

Aspects of one or more embodiments of the present invention are directed toward a scan driving circuit that may be driven according to an overlapping driving method, has a simple circuit construction, and requires only a small number of driving signals, and a display apparatus using the same.

One or more embodiments of the present invention provide a full-swing driving capable scan driving circuit that uses a PMOS transistor.

According to an embodiment of the present invention, there is provided a scan driving circuit for supplying a scan signal to a display apparatus that includes a plurality of pixels. The scan driving circuit includes n stages for generating and outputting scan signals, respectively, wherein the n stages are configured to sequentially output the scan signals overlapping with each other by h horizontal cycles, respectively, where each of the n stages is configured to be driven by a clock signal from among a (h+1)-phase clock signal including first to $(h+1)^{th}$ clock signals and a clock signal from among a (h+1)-phase inverted clock signal including inverted clock signals that are inverted signals of the first to $(h+1)^{th}$ clock signals, the n stages are coupled to a start pulse signal input line in a cascaded manner, h denotes a natural number less than or equal to n−1, and n is a natural number.

Each of the n stages may include a clock terminal, an inverted clock terminal, an input terminal, and an output terminal for outputting a scan signal. The clock terminal may be configured to be supplied with a clock signal from among the (h+1)-phase clock signal and the (h+1)-phase inverted clock signal. The inverted clock terminal may be configured to be supplied with an inverted signal of the clock signal supplied to the clock terminal. The input terminal may be coupled to the start pulse signal input line in the cascaded manner. Each of the n stages may include a first transistor including a gate terminal coupled to the clock terminal and coupled between a first supply voltage line and a first node; a second transistor including a gate terminal coupled to a second node and coupled between the first node and the inverted clock terminal; and a third transistor including a gate terminal coupled to the clock terminal and coupled between the second node and the input terminal. The first supply voltage line may be configured to be applied with a first supply voltage to turn off the first to third transistors, and the output terminal may be coupled to the first node.

Each of the n stages may include a clock terminal, an inverted clock terminal, an input terminal, and an output terminal for outputting a scan signal. The clock terminal may be configured to be supplied with a clock signal from among the (h+1)-phase clock signal and the (h+1)-phase inverted clock signal. The inverted clock terminal may be configured to be supplied with an inverted signal of the clock signal supplied to the clock terminal. The input terminal may be coupled to the start pulse signal input line in the cascaded manner. Each of the n stages may include a first transistor including a gate terminal coupled to a third node and coupled between a first supply voltage line and a first node; a second transistor including a gate terminal coupled to second node and coupled between the first node and the inverted clock terminal; a third transistor including a gate terminal coupled to the third node and coupled between the second node and the input terminal; a fourth transistor having a gate terminal coupled to the clock terminal and coupled between a second supply voltage line and the third node; and a fifth transistor having a gate terminal coupled to the inverted clock terminal and coupled between the first supply voltage line and the third node. The first supply voltage line may be configured to be supplied with a first supply voltage to turn off the first to third transistors, and the second supply voltage line may be configured to be supplied with a second supply voltage to turn on the first to fifth transistors. The output terminal may be coupled to the first node.

Each of the n stages may further include a capacitor coupled between the first node and the second node.

The first to $(h+1)^{th}$ stages may be configured to be supplied with a start pulse signal, and each of the $(h+2)^{th}$ to n stages may be coupled to a preceding stage thereof in the dependent manner. A start pulse signal may be configured to be activated for at least (2h+1) horizontal cycles.

Time periods in which the first clock signal and a start pulse signal are driven may include a first time period during which the first clock signal is at a first logic level, and the start pulse signal is maintained at the first logic level for at least h horizontal cycles and then changes to a second logic level; a second time period during which both the first clock signal and the start pulse signal are at the second logic level; a third time period during which the first dock signal is at the first logic level, and the start pulse signal is maintained at the second logic level for at least h horizontal cycles and then changes to the first logic level; a fourth time period during which the first clock signal is at the second logic level, and the start pulse signal is at the first logic level; and a fifth time period during which the start pulse signal is maintained at the first logic level. The second to $(h+1)^{th}$ dock signals may be driven to be delayed sequentially by one horizontal cycle starting from the first dock signal. The first logic level may correspond to a voltage for turning off transistors included in the n stages, and the second logic level may correspond to a voltage for turning on the transistors included in the n stages.

Each of the n stages may include a clock terminal and an inverted clock terminal, the clock terminals of the n stages may be configured to be sequentially supplied with the first to $(h+1)^{th}$ clock signals and the first to $(h+1)^{th}$ inverted clock signals. The inverted clock terminals of the n stages may be configured to be supplied with inverted signals of the clock signals supplied to the dock terminals. In the n stages, a connection pattern of the clock terminals and the inverted clock terminals may be repeated for every (2h+2) stages.

The scan signals may overlap with each another by one horizontal cycle. The scan driving circuit may be configured to be driven by the first and second clock signals and the first and second inverted clock signals. Each of the n stages may include a clock terminal, an inverted clock terminal, an input terminal, and an output terminal. The clock terminal and inverted clock terminal of a $(4a+1)^{th}$ stage may be configured to be, respectively, supplied with the first dock signal and the first inverted clock signal, where a denotes an integer equal to or greater than "0" and less than "n/4." The clock terminal and inverted clock terminal of a $(4a+2)^{th}$ stage may be configured to be, respectively, supplied with the second clock signal and the second inverted clock signal. The clock terminal and inverted clock terminal of a $(4a+3)^{th}$ stage may be configured to be, respectively, supplied with the first inverted clock signal and the first clock signal. The clock terminal and inverted clock terminal of a $(4a+4)^{th}$ stage may be configured to be, respectively, supplied with the second inverted clock signal and the second clock signal. The input terminals of the first and second stages may be configured to be supplied with a start pulse signal. The input terminal of each of the third to $n^{th}$ stages may be coupled to the output terminal of a stage two (2) stages prior.

The scan signals may overlap with each another by two horizontal cycles. The scan driving circuit may be configured to be driven by the first to third clock signals and the first to third inverted clock signals. Each of the n stages may include a clock terminal, an inverted clock terminal, an input terminal, and an output terminal. The clock terminal and inverted clock terminal of a $(6b+1)^{th}$ stage may be configured to be, respectively, supplied with the first clock signal and the first inverted clock signal, where b denotes an integer equal to or greater than "0" and less than "n/6." The dock terminal and inverted clock terminal of a $(6b+2)^{th}$ stage may be configured to be, respectively, supplied with the second clock signal and the second inverted clock signal. The clock terminal and inverted clock terminal of a $(6b+3)^{th}$ stage may be configured to be, respectively, supplied with the third clock signal and the third inverted dock signal. The clock terminal and inverted clock terminal of a $(6b+4)^{th}$ stage may be configured to be, respectively, supplied with the first inverted clock signal and the first dock signal. The clock terminal and inverted clock terminal of the $(6b+5)^{th}$ stage may be configured to be, respectively, supplied with the second inverted clock signal and the second clock signal. The clock terminal and inverted clock terminal of a $(6b+6)^{th}$ stage may be configured to be, respectively, supplied with the third inverted clock signal and the third dock signal. The input terminals of the first to third stages may be configured to be supplied with a start pulse signal. The input terminal of each of the fourth to $n^{th}$ stages is coupled to an output terminal of a stage three (3) stages prior.

The display apparatus may be an organic electro-luminescent display device.

The scan signals may be activated for (h+1) horizontal cycles.

According to another embodiment of the present invention, there is provided a display apparatus including a plurality of pixels arranged at crossing regions of data lines and scan lines; a scan driver for supplying scan signals to the plurality of pixels via the scan lines, respectively; and a data driver for generating a data signal corresponding to an image, and supplying the data signal to the plurality of pixels via the data lines, respectively. The scan driver may include a scan driving circuit of one of the above described embodiments.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Hereinafter, exemplary embodiments of the present invention will be described more fully with reference to the accompanying drawings. In the following description, well-known functions or constructions may not be described in detail.

The present invention may, however, be embodied in many different forms and should not be construed as being limited to the embodiments set forth herein. Rather, these embodiments are provided so that this disclosure will be thorough and complete and will fully convey the concept of the invention to those skilled in the art. The specific terms used in the present disclosure are not intended to restrict the scope of the present invention and only used for a better understanding of (for facilitating the understanding of) the present invention.

Figure 1:
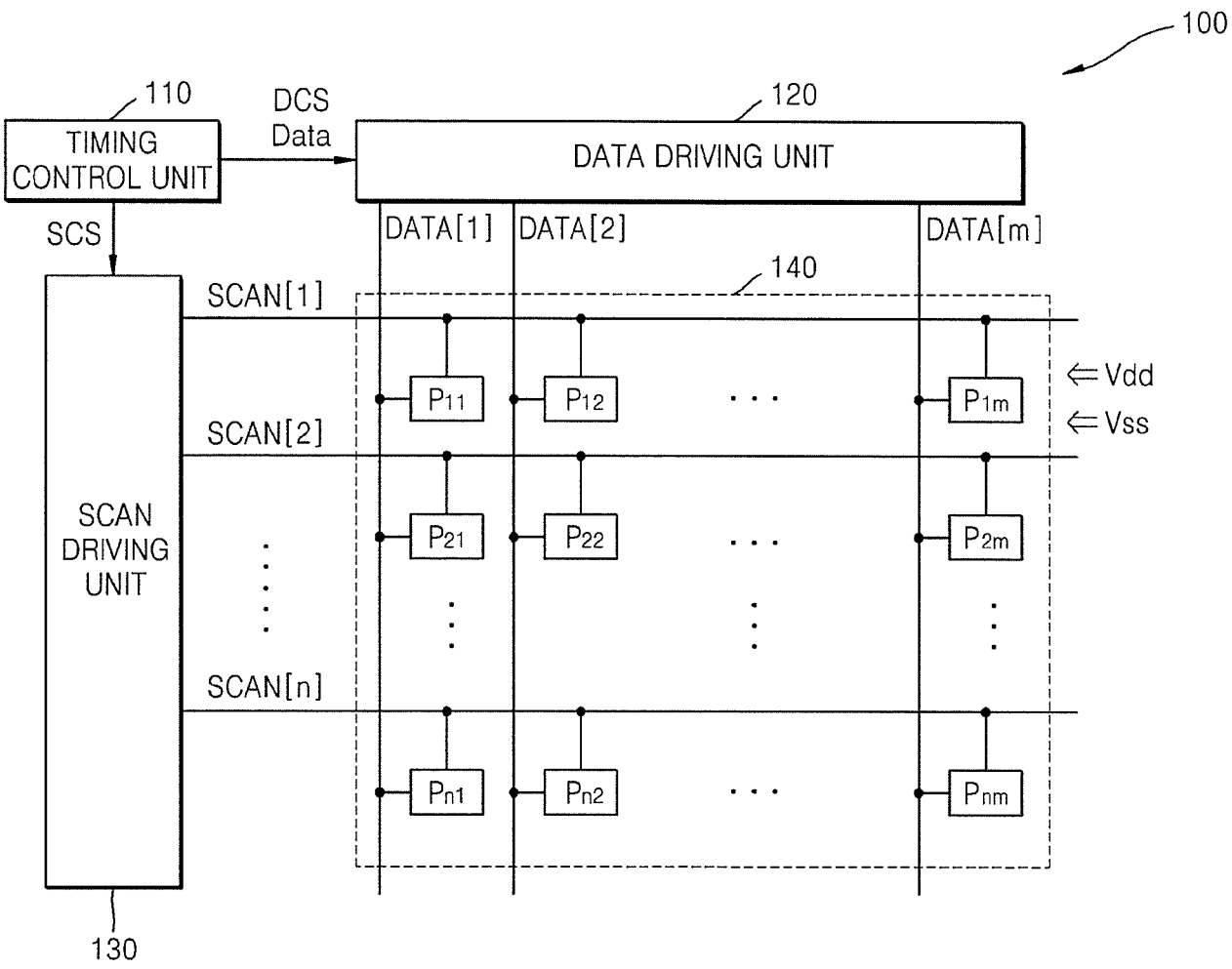
FIG. 1 is a circuit diagram of a display apparatus according to an embodiment of the present invention.

FIG. 1 is a circuit diagram of a display apparatus 100 according to an embodiment of the present invention. Referring to FIG. 1, the display apparatus 100 includes a timing control unit 110 for controlling a data driving unit (e.g., a data driver) 120 and a scan driving unit (e.g., a scan driver) 130, the data driving unit 120 being for driving data lines DATA[1] to DATA[m], the scan driving unit 130 being for driving scan lines SCAN[1] to SCAN[n], and a display unit (e.g., a pixel unit) 140 that includes pixels $P_{11}$ to $P_{nm}$ coupled to the scan lines SCAN[1] to SCAN[n] and the data lines DATA[1] to DATA[m].

In the display unit 140, the pixels $P_{11}$ to $P_{nm}$ are located at crossing regions of the scan lines SCAN[1] and SCAN[n] and the data lines DATA[1] to DATA[m]. The pixels $P_{11}$ to $P_{nm}$ may be arranged in a matrix of n×m as illustrated in FIG. 1. A first supply voltage Vdd and a second supply voltage Vss may be applied to the pixels $P_{11}$ to $P_{nm}$ from a power supply unit. Each of the pixels $P_{11}$ to $P_{nm}$ includes a light-emitting device, and applies a driving current or a driving voltage to the light-emitting device so as to cause the light-emitting device to emit light having brightness corresponding to a data signal. The type of the light-emitting device may suitably vary according to the type of the display apparatus 100. In one or more embodiments of the present invention, the display apparatus 100 may be any of an organic electro-luminescent display device, a liquid crystal display (LCD), a field emission display (FED), a plasma display panel (PDP), and so on. In one embodiment, the light-emitting device is embodied as an organic light emitting device (OLED).

Each of the pixels $P_{11}$ to $P_{nm}$ controls the amount of current supplied to the OLED thereof according to the data signal delivered via one of the data lines DATA[1] to DATA[m]. Then, the OLED emits light having brightness corresponding to the data signal.

The timing control unit 110 generates, for example, RGB data Data and a data driver control signal DCS and outputs them to the data driver 120, and generates, for example, a scan driver control signal SCS and outputs it to the scan driver 130.

The data driving unit 120 generates a data signal from the RGB data Data, and supplies the data signal to the pixels $P_{11}$ to $P_{nm}$ via the data lines DATA[1] to DATA[m]. The data driving unit 120 may generate the data signal from the RGB data Data by, for example, a gamma filter or a digital-to-analog converter. Each of the data lines DATA[1] to DATA[m] for delivering the data signal may be coupled to a plurality of pixels extending along the same column.

The scan driving unit 130 generates a scan signal from a scan driver control signal SCS and supplies the scan signal to the pixels $P_{11}$ to $P_{nm}$ via the scan lines SCAN[1] to SCAN[n]. Each of the scan lines SCAN[1] to SCAN[n] may be coupled to a plurality of pixels extending along the same row. The scan lines SCAN[1] to SCAN[n] may be driven sequentially row-by-row or line-by-line. In another embodiment of the display apparatus 100, the scan driving unit 130 may further generate a driving signal, such as a light emission control signal, and supply it to the pixels $P_{11}$ to $P_{nm}$.

Figure 2:
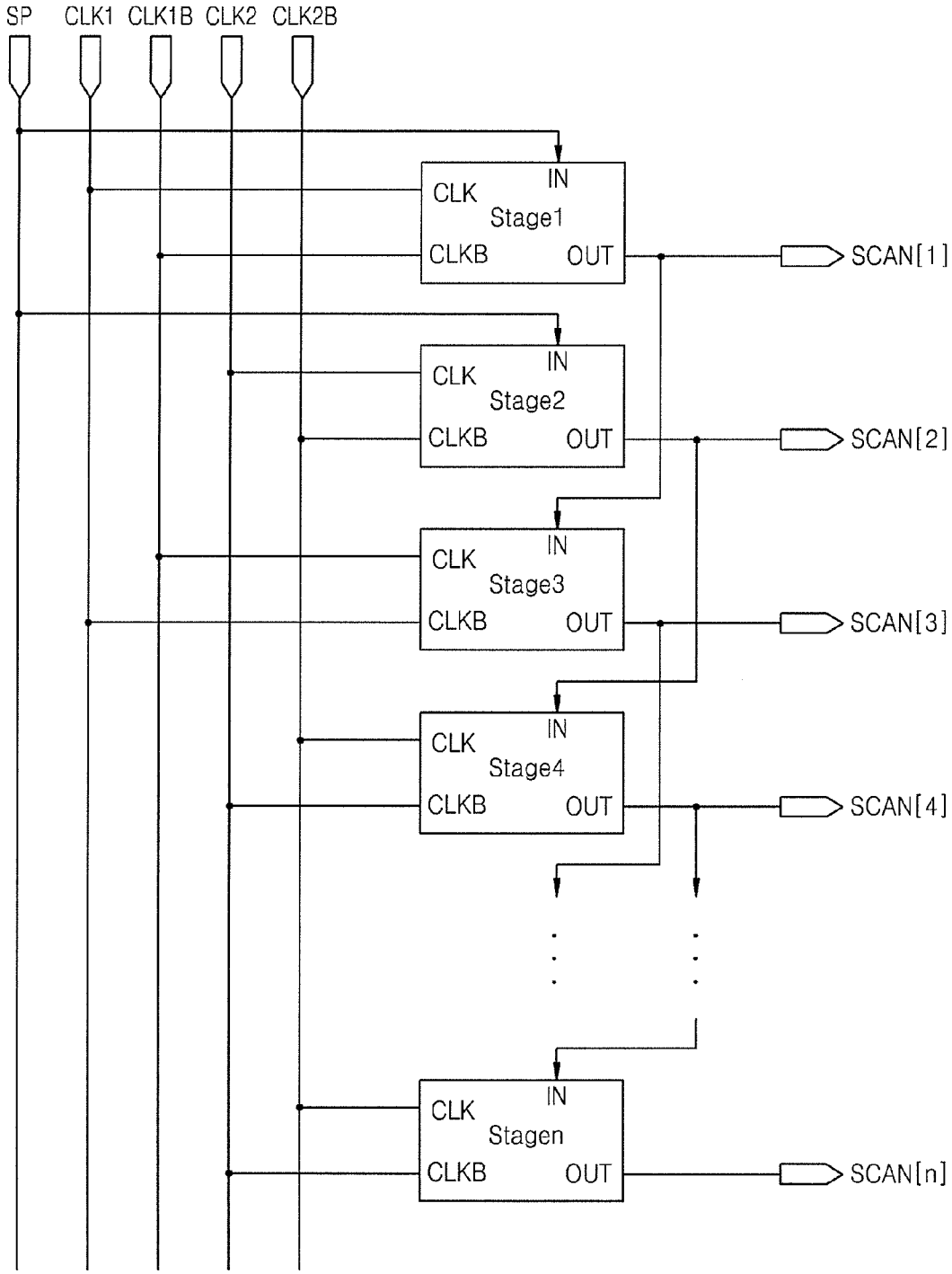
FIG. 2 is a circuit diagram of a scan driving circuit that may be included in a scan driving unit of the display apparatus of FIG. 1, according to an embodiment of the present invention.

FIG. 2 is a circuit diagram of a scan driving circuit that may be included in the scan driving unit 130 of the display apparatus of FIG. 1, according to an embodiment of the present invention. Referring to FIG. 2, the scan driving circuit includes n stages, Stage_1 to Stage_n, coupled in a cascaded manner, where n denotes an integer equal to or greater than "1." Each of the n stages, Stage_1 to Stage_n, is directly coupled to a start pulse signal SP input line or indirectly coupled to the start pulse signal SP input line through one or more previous stages. Each of the n stages, Stage_1 to Stage_n, has a clock terminal CLK coupled to a clock signal line from among lines for 2-phase clock signal CLK1 and CLK2 and lines for 2-phase inverted clock signal CLK1B and CLK2B, and has an inverted clock terminal CLKB coupled to an inverted clock signal line corresponding to the clock signal line coupled to the clock terminal CLK. The first inverted clock signal CLK1B is an inverted signal of the first clock signal CLK1, and the second inverted clock signal CLK2B is an inverted signal of the second clock signal CLK2. The first and second clock signals CLK1 and CLK2 may have a clock cycle corresponding to 4 horizontal cycles 4H and may have a phase difference with each other by one horizontal cycle 1H.

In one embodiment, the first clock signal CLK1 and the first inverted clock signal CLK1B are supplied to the clock terminal CLK and inverted clock terminal CLKB of a $(4a+1)^{91}$ stage, respectively, where "a" denotes an integer equal to or greater than "0" and less than "n/4"). The second clock signal CLK2 and the second inverted clock signal CLK2B are supplied to the clock terminal CLK and inverted clock terminal CLKB of a $(4a+2)^{th}$ stage, respectively. The first inverted clock signal CLKB1 and the first clock signal CLK1 are supplied to the clock terminal CLK and inverted clock terminal CLKB of a $(4a+3)^{th}$ stage, respectively. The second inverted clock signal CLK2B and the second clock signal CLK2 are supplied to the clock terminal CLK and inverted clock terminal CLKB of a $(4a+4)^{th}$ stage, respectively. Accordingly, the stages, Stage_1 to Stage_n, are each sequentially driven by one horizontal cycle 1H later than a preceding stage thereof.

In the scan driving circuit of FIG. 2, output terminals OUT of the n stages, Stage_1 to Stage_n, are coupled to the n scan lines SCAN[1] to SCAN[n], which are coupled to the display unit 140 of FIG. 1, respectively.

The start pulse signal SP may be supplied to input terminals IN of the first and second stages Stage_1 and Stage_2. Each of the third to $n^{th}$ stages Stage_3 to Stage_n may be coupled to the first stage or second stage in a cascaded manner such that an input terminal of each of the third to $n^{th}$ stages is coupled to the output terminal OUT of a stage that is two (2) stages prior. That is, the output terminal OUT of the first stage Stage_1 may be coupled to the input terminal IN of the third stage Stage_3, and the output terminal of the second stage Stage_2 may be coupled to the input terminal IN of the fourth stage Stage_4. Accordingly, the n stages, Stage_1 to Stage_n, may be driven according to an overlapping driving method.

According to one or more embodiments of the present invention, the overlapping driving method is employed to drive a display apparatus, such as a large-scale display panel, in which its signal lines or electrodes have higher loading when being driven. Thus, it is possible to increase a time period during which a scan signal is activated while a driving speed is maintained at a same level, thereby enabling a large-scale display panel to be driven at a high frequency. Also, according to one or more embodiments of the present invention, it is possible to improve a compensation capability of a pixel circuit and to drive a high load even when a high frequency of 240 Hz or more is applied for driving a three-dimensional (3D) display apparatus.

Figure 3:
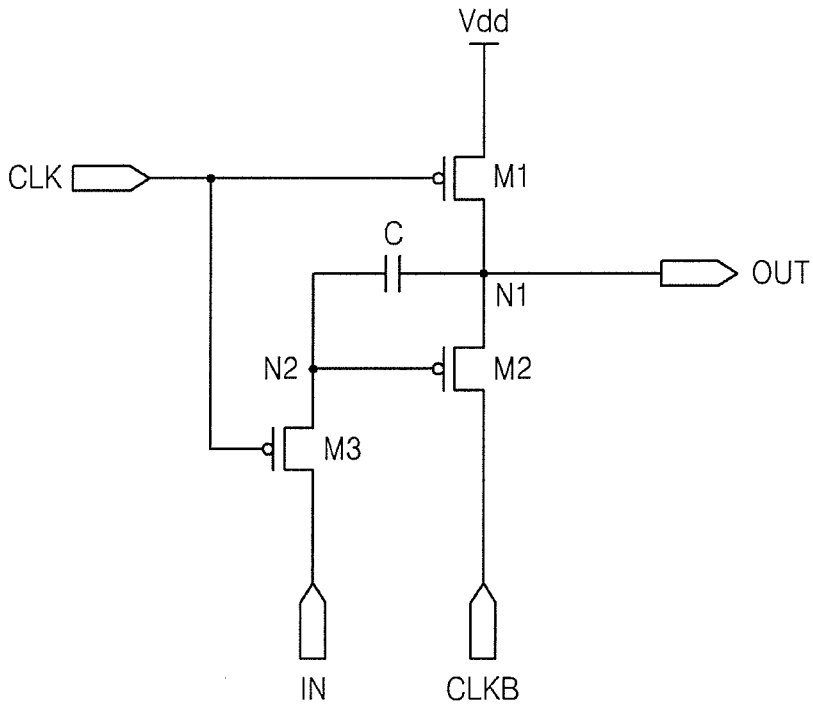
FIG. 3 is a circuit diagram of a stage of the scan driving circuit of FIG. 2 according to an embodiment of the present invention.

FIG. 3 is a circuit diagram of a stage Stage_i of the scan driving circuit of FIG. 2 according to an embodiment of the present invention, wherein i denotes an integer between 1 and n. The stage Stage_i includes a first transistor M1, a second transistor M2, a third transistor M3, and a capacitor C. The first to third transistors M1 to M3 may be P-type Metal Oxide Semiconductor Field Effect Transistors (MOSFETs) (hereinafter, referred to as "PMOS transistors").

The first transistor M1 is coupled between a first supply voltage Vdd line and a first node N1, and has a gate terminal coupled to a clock terminal CLK. The second transistor M2 is coupled between the first node N1 and an inverted clock terminal CLKB, and has a gate terminal coupled to a second node N2. The third transistor M3 is coupled between the second node N2 and an input terminal IN, and has a gate terminal coupled to the clock terminal CLK. The capacitor C is coupled between the first node N1 and the second node N2.

Figure 4:
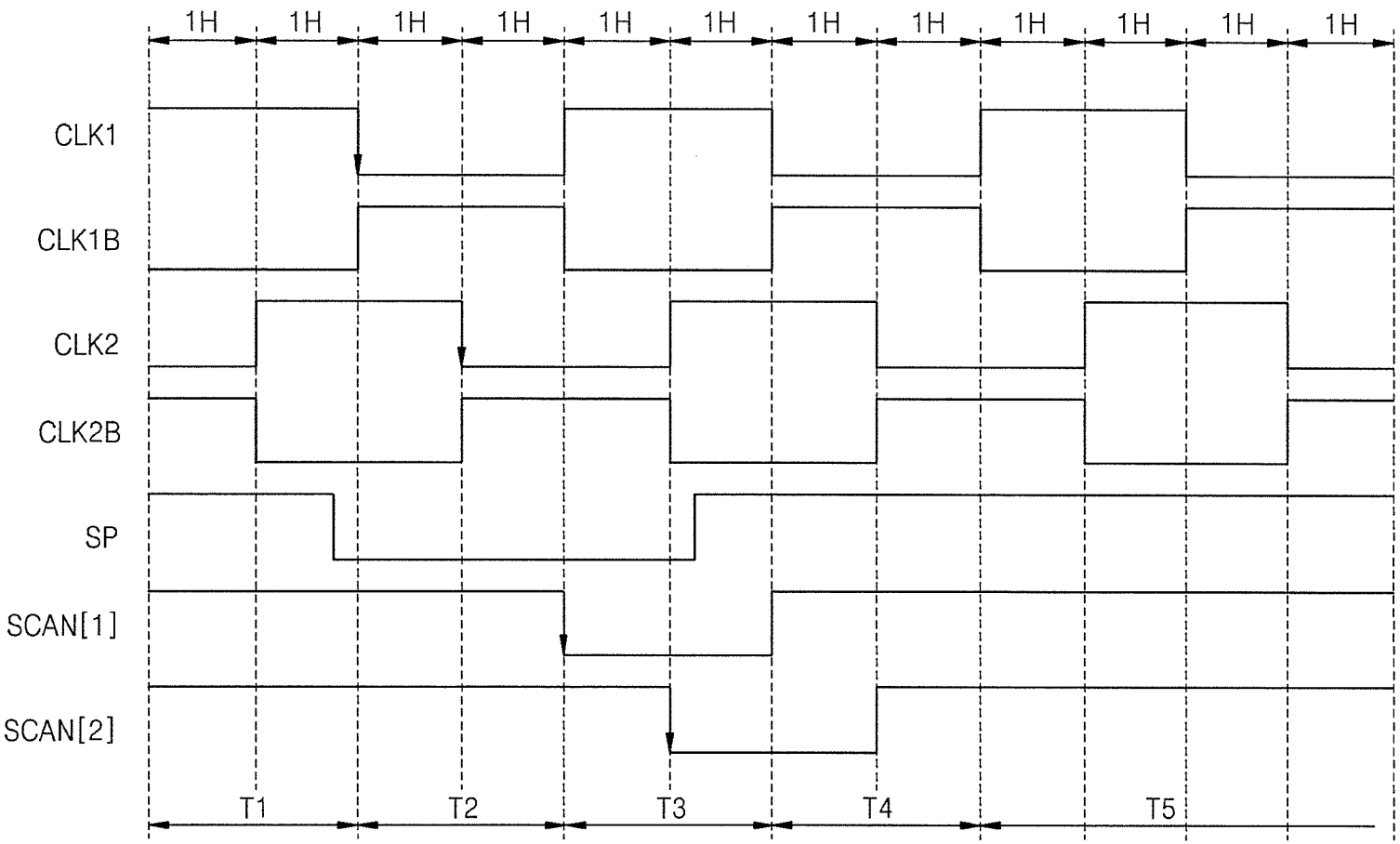
FIG. 4 is a timing diagram of driving signals for driving a scan driving circuit according to an embodiment of the present invention.

FIG. 4 is a timing diagram of driving signals for driving a scan driving circuit according to an embodiment of the present invention. The scan driving circuit according to one embodiment will now be described with reference to FIGS. 2 to 4.

The first stage Stage_1 will first be described. In a first time period T1, the first clock signal CLK1 is in logic high and the first inverted clock signal CLK1B is in logic low. A start pulse signal SP changes from logic high to logic low before the first time period T1 ends. Since the first clock signal CLK1 is in logic high, a scan signal that is in logic high is output from the output terminal OUT of a $(4a+1)^{th}$ stage to which the first clock signal CLK1 is supplied while first and third transistors M1 and M3 of the $(4a+1)^{th}$ stage are turned off. Here, "a" denotes an integer equal to or greater than "0" and less than "n/4."

In a second time period T2, the first clock signal CLK1 is in logic low, and thus, the first and third transistors M1 and M3 are turned on. Also, in the first stage Stage_1, since the start pulse signal SP is in logic low, a low voltage is applied to the second node N2 and the second transistor M2 is thus turned on. If the first transistor M1 is turned on, a high voltage is applied to the first node N1 from the first supply voltage Vdd line, and the capacitor C is charged with a logic high voltage. Thus, a scan signal delivered via the first scan line SCAN[1] is maintained at a logic "high" level. In this case, the first inverted clock signal CLK1B in logic high is supplied to a drain electrode of the second transistor M2. Thus, a voltage applied between the source and drain terminals of the second transistor M2 is substantially 0V, and a direct current is prevented from being supplied via the second transistor M2.

In a third time period T3, the first clock signal CLK1 is in logic high, and thus, the first and third transistors M1 and M3 are turned off and the second node N2 is floated. In the third time period T3, the second transistor M2 is kept turned on and the first inverted clock signal CLK1B is in logic low. Thus, a low voltage is applied to the first node N1 via the second transistor M2, and the voltage of the first node N1 is lowered by the low voltage of the first inverted clock signal CLK1B. Here, because the transistor M3 is turned off, the second node N2 coupled to one terminal of the capacitor C is floated. Thus, the voltage of the second node N2 is lowered sufficiently by a drop in the voltage of the first node N1, thereby enabling the output of the scan driving circuit to be fully driven low. Accordingly, a scan signal that is in logic low is output from the scan line SCAN[i] coupled to the first node N1.

As described above, the capacitor C is coupled between the first node N1 and the second node N2, and maintains the voltage applied between the source and gate terminals of the second transistor M2 at a substantially constant level. The capacitor C allows the output of the scan driving circuit to be fully driven low, and the scan driving circuit may perform full-swing within the range of a driving voltage.

In a fourth time period T4, the first clock signal CLK1 is in logic low, and thus, the first and third transistors M1 and M3 are turned on. The start pulse signal SP is in logic high, and a high voltage is applied to the second node N2 via the third transistor M3. If the high voltage is applied to the second node N2, the second transistor M2 is turned off and a high voltage is applied to the first node N1 from the first supply voltage Vdd line via the first transistor M1. Since the voltage of the first node N1 is high, the voltage of the first scan line SCAN [1] is high. Here, the voltages of the first node N1 and the second node N2 are high, and thus, the capacitor C is discharged.

In a fifth time period T5 after the fourth time period T4 ends and before a subsequent start pulse signal SP is supplied, the first scan line SCAN[1] is maintained at a logic "high" level and is refreshed to stay high by the first supply voltage Vdd whenever the first clock signal CLK1 is in logic low.

A scan signal of the first scan line SCAN[1] from the output terminal OUT of the first stage Stage_1 is supplied from the scan driving unit 130 not only to the pixels $P_{11}$ to $P_{1m}$ in the first row but also to the input terminal IN of the third stage Stage_3. The scan signal of the first scan line SCAN[1] while logic low supplied to the input terminal IN of the third stage Stage3 acts as the start pulse signal SP in the third stage Stage_3 and drives the third scan line SCAN[3]. The clock terminal CLK and inverted clock terminal CLKB of the third stage Stage3 are coupled to the first inverted clock signal CLK1B line and the first clock signal CLK1 line, respectively. Thus, the third stage Stage_3 is driven by one horizontal cycle 1H later than the second stage Stage_2. Similarly, each of the following odd-numbered stages receives a scan signal from the output terminal OUT of a stage two (2) stages prior via the input terminal IN thereof and sequentially outputs the scan signal.

Next, the second stage Stage_2 will be described. In the second stage Stage_2, the second clock signal CLK2 acts as the first clock signal CLK1 in the first stage Stage_1, and the second inverted clock signal CLK2B acts as the first inverted clock signal CLK1B in the first stage Stage_1. The second clock signal CLK2 is output by one horizontal cycle 1H later than the first clock signal CLK1, and the second inverted clock signal CLK2B is output by one horizontal cycle 1H later than the first inverted clock signal CLK1B. Thus, the second stage Stage_2 is driven by one horizontal cycle 1H later than the first stage Stage_1. Accordingly, the second scan signal SCAN[2] overlaps with the first scan signal SCAN[1] for one horizontal cycle 1H.

The start pulse signal SP changes from logic high to logic low during the first time period T1, and in one embodiment, at least after the second clock signal CLK2 changes to logic high during the first time period T1. Also, the start pulse signal SP changes from logic low to logic high during the third time period T3, and in one embodiment, at least after the second clock signal CLK2 changes to logic high during the third time period T3. Accordingly, in one embodiment, the start pulse signal SP is activated at a logic "low" level for at least three horizontal cycles 3H.

Even-numbered stages are driven dependently with the start pulse signal SP supplied to the input terminal IN of the second stage Stage_2. That is, a scan signal output from the output terminal OUT of the second stage Stage_2 is supplied to the input terminal IN of the fourth stage Stage_4 so as to drive the fourth stage Stage_4. The clock terminal CLK and inverted clock terminal CLKB of the fourth stage Stage_4 are coupled to the second inverted clock signal CLK2B line and the second clock signal CLK2 line, respectively. Thus, the fourth stage Stage_4 is driven by one horizontal cycle 1H later than the third stage Stage_3. Similarly, each of the following even-numbered stages receives a scan signal from the output terminal OUT of a stage two (2) stages prior via the input terminal IN thereof, and sequentially outputs the scan signal.

As described above, according to one or more embodiments of the present invention, each stage may be constructed with a relatively small number of transistors, and a scan driving circuit may be driven by using a relatively small number of driving signals (e.g., clock signals and inverted clock signals). That is, according to one or more embodiments of the present invention, the scan driving circuit may be driven by using 2h+2 driving signals when scan signals overlap with each other for h horizontal cycles. Here, h denotes a natural number.

Figure 5:
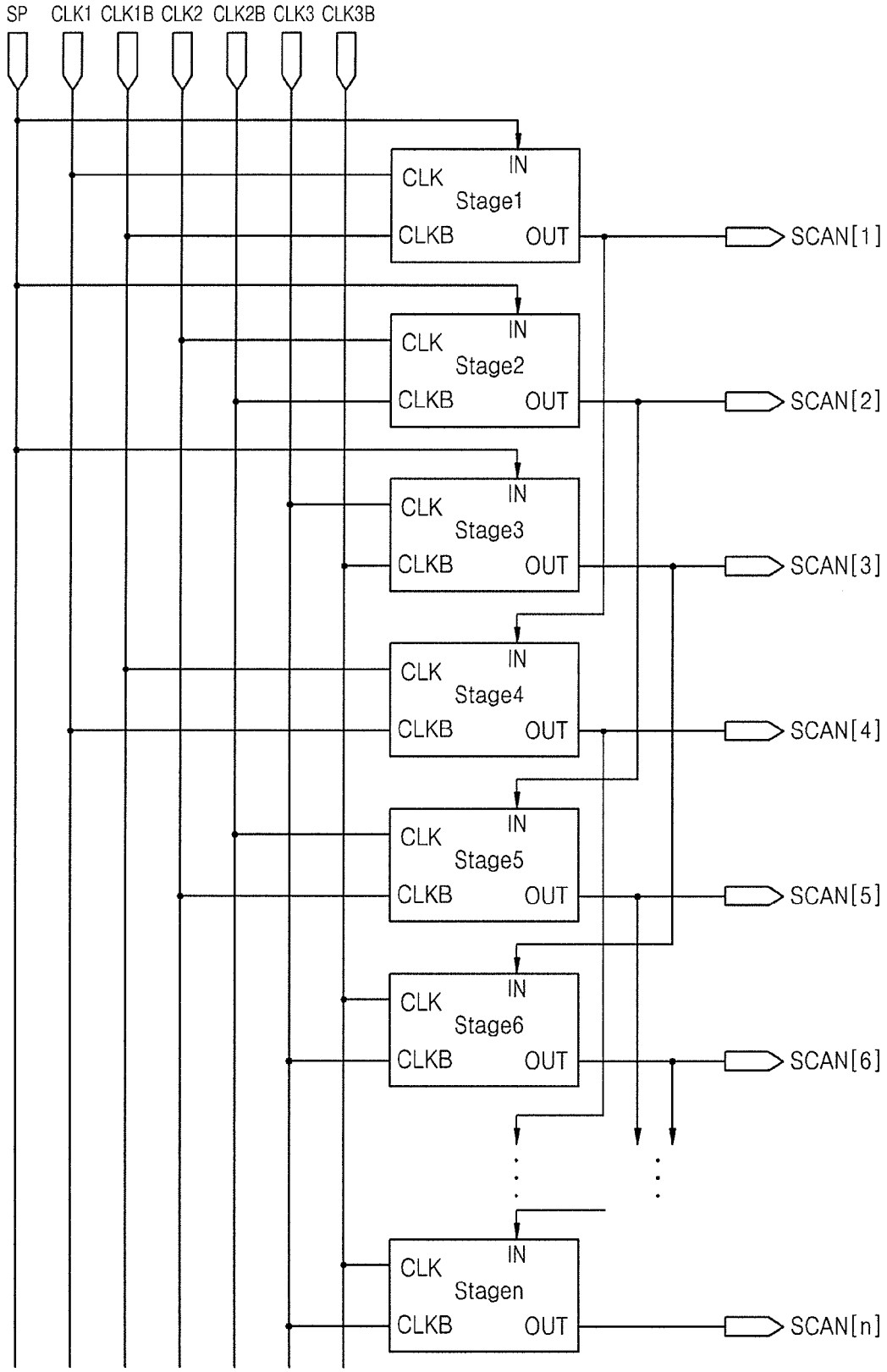
FIG. 5 is a circuit diagram of a scan driving circuit that may be included in the scan driving unit of the display apparatus of FIG. 1, according to another embodiment of the present invention.

FIG. 5 is a circuit diagram of a scan driving circuit that may be included in the scan driving unit 130 of the display apparatus of FIG. 1, according to another embodiment of the present invention. Referring to FIG. 5, n stages, Stage_1 to Stage_n, are driven by using 3-phase clock signals CLK1, CLK2, and CLK3 and 3-phase inverted clock signals CLK1B, CLK2B, and CLK3B, and scan signals are driven while overlapping with each other for two horizontal cycles 2H. Each of the stages, Stage_1 to Stage_n, has a clock terminal CLK coupled to a clock signal line from among lines for the 3-phase clock signals CLK1, CLK2, and CLK3 and lines for the 3-phase inverted clock signals CLK1B, CLK2B, and CLK3B, and has an inverted clock terminal CLKB coupled to an inverted clock signal line corresponding to the clock signal line coupled to the clock terminal CLK. The 3-phase clock signals CLK1, CLK2, and CLK3 include a first clock signal CLK1, a second clock signal CLK2 output by one horizontal cycle 1H later than the first clock signal CLK1, and a third clock signal CLK3 output by one horizontal cycle 1H later than the second clock signal CLK2. First to third inverted clock signals CLK1B to CLK3B are inverted signals of the first to third clock signals CLK1 to CLK3, respectively. The first to third clock signals CLK1, CLK2, and CLK3 and the first to third inverted clock signals CLK1B, CLK2B, and CLK3B may have a clock cycle of 6H.

In one embodiment, a clock terminal CLK and an inverted clock terminal CLKB of a $(6b+1)^{th}$ stage are coupled to the first clock signal CLK1 line and the first inverted clock signal CLK1B, respectively, where "b" denotes an integer equal to or greater than "0" and less than "n/6". A clock terminal CLK and inverted clock terminal CLKB of a $(6b+2)^{th}$ stage are coupled to the second clock signal CLK2 line and the second inverted clock signal CLK2B, respectively. A clock terminal CLK and inverted clock terminal CLKB of a $(6b+3)^{th}$ stage are coupled to the third clock signal CLK3 line and the third inverted clock signal CLK3B, respectively. A clock terminal CLK and inverted clock terminal CLKB of a $(6b+4)^{th}$ stage are coupled to the first inverted clock signal CLK1B line and the first clock signal CLK1, respectively. A clock terminal CLK and inverted clock terminal CLKB of a $(6b+5)^{th}$ stage are coupled to the second inverted clock signal CLK2B line and the second clock signal CLK2 line, respectively. A clock terminal CLK and inverted clock terminal CLKB of a $(6b+6)^{th}$ stage are coupled to the third inverted clock signal CLK3B line and the third clock signal CLK3 line, respectively. Accordingly, each of the stages, Stage_1 to Stage_n, is sequentially driven by one horizontal cycle 1H later than a preceding stage thereof.

A start pulse signal SP may be supplied to input terminals IN of the first to third stages Stage_1 to Stage_3. Each of the fourth to $n^{th}$ stages, Stage_4 to Stage_n, may be coupled in a dependent manner such that a scan signal may be supplied from the output terminal OUT of a stage three (3) stages prior to the input terminal IN thereof. That is, the output terminal OUT of the first stage Stage_1 may be coupled to the input terminal IN of the fourth stage Stage_4, the output terminal OUT of the second stage Stage_2 may be coupled to the input terminal IN of the fifth stage Stage_5, and the output terminal OUT of the third stage Stage_3 may be coupled to the input terminal IN of the sixth stage Stage_6.

Figure 6:
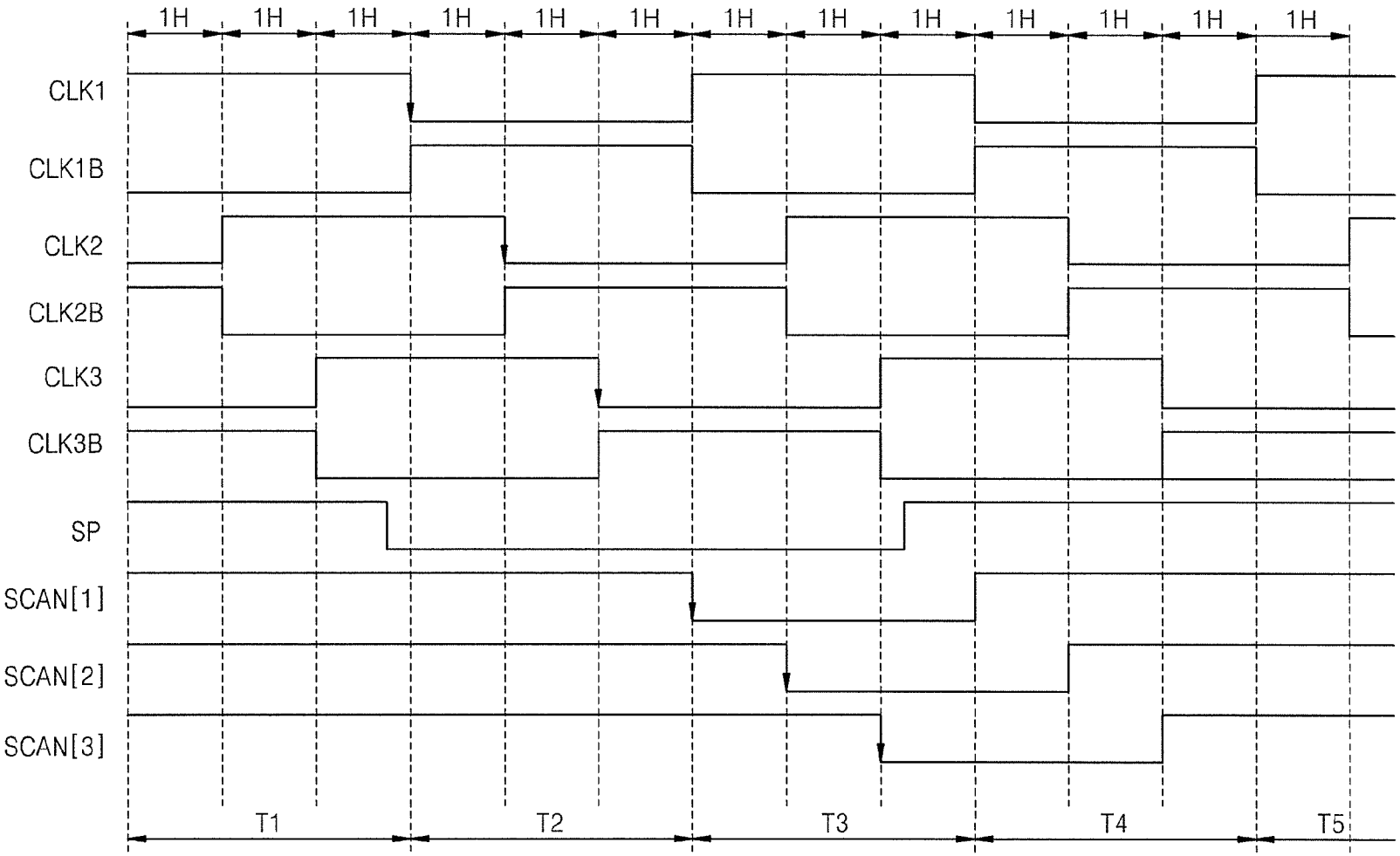
FIG. 6 is a timing diagram of driving signals for driving a scan driving circuit according to another embodiment of the present invention.

FIG. 6 is a timing diagram of driving signals for driving a scan driving circuit according to another embodiment of the present invention. In FIG. 6, the first to third clock signals CLK1 to CLK3 are out of phase with each other by one horizontal cycle 1H. The scan signals SCAN[1] to SCAN[n] are sequentially output at intervals of one horizontal cycle 1H and overlap with each other by two horizontal cycles 2H.

Referring to FIG. 6, a start pulse signal SP changes from logic high to logic low during a first time period T1, and in one embodiment, at least after the third clock signal CLK3 changes to logic high during the first time period T1. Also, the start pulse signal SP changes from logic low to logic high during the third time period T3, and in one embodiment, at least after the third clock signal CLK3 changes to logic high during the third time period T3. Accordingly, in one embodiment, the start pulse signal SP is activated at a logic "low" level for at least five horizontal cycles 5H.

The operation of each stage of FIG. 5 is as described above with reference to FIGS. 3 and 4.

Figure 7:
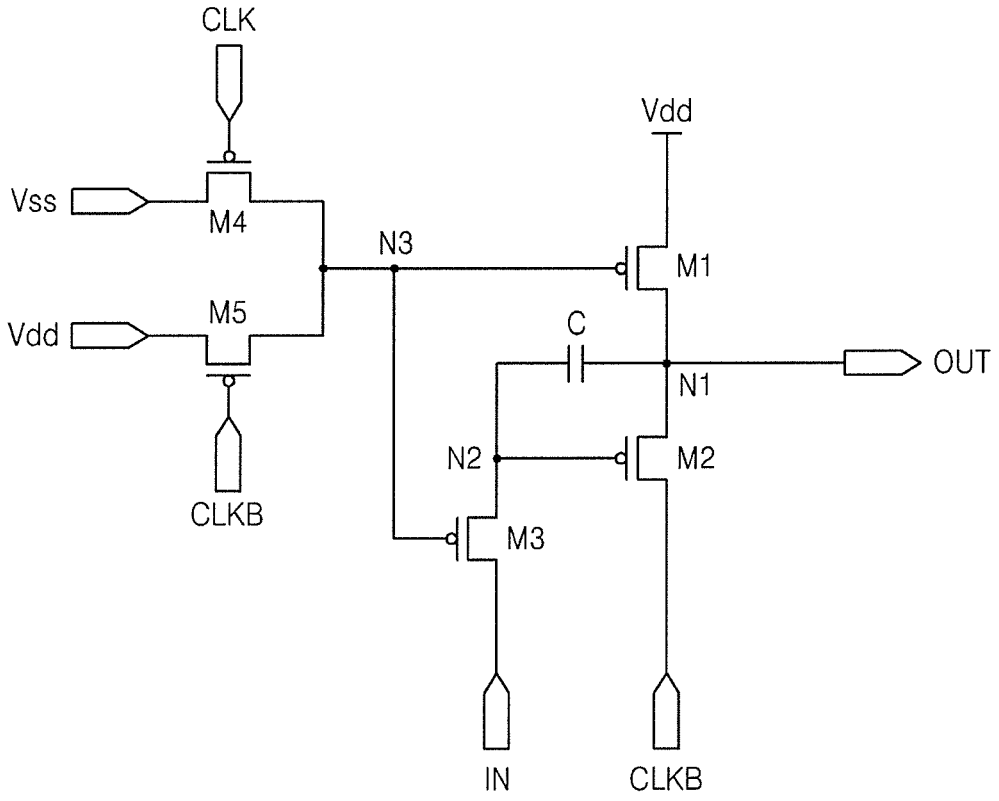
FIG. 7 is a circuit diagram of a stage of a scan driving circuit according to another embodiment of the present invention.

FIG. 7 is a circuit diagram of a stage Stage_i of a scan driving circuit according to another embodiment of the present invention, wherein i denotes an integer from 1 to n. The stage Stage_i includes first to fifth transistors M1 to M5, and a capacitor C. The first transistor M1 is coupled between a first supply voltage Vdd line and a first node N1 and has a gate terminal coupled to a third node N3. The second transistor M2 is coupled between the first node N1 and the inverted clock terminal CLKB and has a gate terminal coupled to a second node N2. A third transistor M3 is coupled between the second node and the input terminal IN and has a gate terminal coupled to the third node N3. The capacitor C is coupled between the first node N1 and the second node N2. The fourth transistor M4 is coupled between a second supply voltage Vss line and the third node N3 and has a gate terminal coupled to the clock terminal CLK. The fifth transistor M5 is coupled between the first supply voltage Vdd line and the third node N3 and has a gate terminal coupled to the inverted clock terminal CLKB.

If a clock signal supplied to the clock terminal CLK is in logic low and a clock signal supplied to the inverted clock terminal CLKB is in logic high, then the fourth transistor M4 is turned on and the fifth transistor M5 is turned off. Thus, a second supply voltage Vss is applied to the third node N3, and the first and third transistors M1 and M3 are turned on. If a clock signal supplied to the clock terminal CLK is in logic high and a clock signal supplied to the inverted clock terminal CLKB is in logic low, then the fourth transistor M4 is turned off and the fifth transistor M5 is turned on. Thus, a first supply voltage Vdd is applied to the third node N3, and the first and third transistors M1 and M3 are turned off. In the embodiment of FIG. 5, the timings and operating principles of driving signals supplied to the stage Stage_i are substantially the same as those of driving signals supplied to the stage Stage_i described above with reference to FIG. 3.

The above embodiments provide a scan driving circuit that may be driven with a relatively small number of transistors according to an overlapping driving method, and that utilizes only a small number of driving signals.

The above embodiments also provide a scan driving circuit that may be full-swing driven by using PMOS transistors.

While the present invention has been particularly shown and described with reference to exemplary embodiments thereof, it will be understood by those of ordinary skill in the art that various changes in form and details may be made thereto without departing from the spirit and scope of the present invention as defined by the following claims and their equivalents.

What is claimed is:

1. A scan driving circuit for supplying a scan signal to a display apparatus comprising a plurality of pixels, the scan driving circuit comprising n stages for generating and outputting scan signals, respectively, wherein:

the n stages are configured to sequentially output the scan signals overlapping with each other by h horizontal cycles, respectively, where each of the n stages is driven by a clock signal from among a (h+1)-phase clock signal comprising first to $(h+1)^{th}$ clock signals and a clock signal from among a (h+1)-phase inverted clock signal comprising inverted clock signals that are inverted signals of the first to $(h+1)^{th}$ clock signals, the n stages are coupled to a start pulse signal input line in a cascaded manner, h denotes a natural number less than or equal to n−1, and n is a natural number, wherein time periods in which the first clock signal and a start pulse signal are driven comprise:

a first time period during which the first clock signal is at a first logic level, and the start pulse signal is maintained at the first logic level for at least h horizontal cycles and then changes to a second logic level;

a second time period during which both the first clock signal and the start pulse signal are at the second logic level;

a third time period during which the first clock signal is at the first logic level, and the start pulse signal is maintained at the second logic level for at least h horizontal cycles and then changes to the first logic level;

a fourth time period during which the first clock signal is at the second logic level, and the start pulse signal is at the first logic level; and a fifth time period during which the start pulse signal is maintained at the first logic level, wherein the second to $(h+1)^{th}$ clock signals are driven to be delayed sequentially by one horizontal cycle starting from the first clock signal, the first logic level corresponds to a voltage for turning off transistors included in the n stages, and the second logic level corresponds to a voltage for turning on the transistors included in the n stages.

2. The scan driving circuit of claim 1, wherein each of the n stages comprises a clock terminal, an inverted clock terminal, an input terminal, and an output terminal for outputting a scan signal, wherein the clock terminal is configured to be supplied with a clock signal from among the (h+1)-phase clock signal and the (h+1)-phase inverted clock signal, the inverted clock terminal is configured to be supplied with an inverted signal of the clock signal supplied to the clock terminal, and the input terminal is coupled to the start pulse signal input line in the cascaded manner, each of the n stages comprises:

a first transistor comprising a gate terminal coupled to the clock terminal and coupled between a first supply voltage line and a first node;

a second transistor comprising a gate terminal coupled to a second node and coupled between the first node and the inverted clock terminal; and a third transistor comprising a gate terminal coupled to the clock terminal and coupled between the second node and the input terminal, and wherein the first supply voltage line is configured to be applied with a first supply voltage to turn off the first and third transistors, and the output terminal is coupled to the first node.

3. The scan driving circuit of claim 2, wherein each of the n stages further comprises a capacitor coupled between the first node and the second node.

4. The scan driving circuit of claim 2, wherein the first to third transistors are PMOS transistors.

5. The scan driving circuit of claim 1, wherein each of the n stages comprises a clock terminal, an inverted clock terminal, an input terminal, and an output terminal for outputting a scan signal, the clock terminal is configured to be supplied with a clock signal from among the (h+1)-phase clock signal and the (h+1)-phase inverted clock signal, the inverted clock terminal is configured to be supplied with an inverted signal of the clock signal supplied to the clock terminal, and the input terminal is coupled to the start pulse signal input line in the cascaded manner, each of the n stages comprises:

a first transistor comprising a gate terminal coupled to a third node and coupled between a first supply voltage line and a first node;

a second transistor comprising a gate terminal coupled to second node and coupled between the first node and the inverted clock terminal;

a third transistor comprising a gate terminal coupled to the third node and coupled between the second node and the input terminal;

a fourth transistor comprising a gate terminal coupled to the clock terminal and coupled between a second supply voltage line and the third node; and a fifth transistor comprising a gate terminal coupled to the inverted clock terminal and coupled between the first supply voltage line and the third node, wherein:

the first supply voltage line is configured to be applied with a first supply voltage to turn off the first and third transistors, the second supply voltage line is configured to be applied with a second supply voltage to turn on the first and third transistors, and the output terminal is coupled to the first node.

6. The scan driving circuit of claim 5, wherein each of the n stages further comprises a capacitor coupled between the first node and the second node.

7. The scan driving circuit of claim 5, wherein the first to fifth transistors are PMOS transistors.

8. The scan driving circuit of claim 1, wherein the first to $(h+1)^{th}$ stages are configured to be supplied with a start pulse signal, and each of the $(h+2)^{th}$ to n stages is coupled to a preceding stage thereof in the cascaded manner.

9. The scan driving circuit of claim 1, wherein each of the n stages comprises a clock terminal and an inverted clock terminal, the clock terminals of the n stages are configured to be sequentially supplied with the first to $(h+1)^{th}$ clock signals and the first to $(h+1)^{th}$ inverted clock signals, the inverted clock terminals of the n stages are configured to be supplied with inverted signals of the clock signals supplied to the clock terminals, and in the n stages, a connection pattern of the clock terminals and the inverted clock terminals is repeated for every (2h+2) stages.

10. The scan driving circuit of claim 1, wherein the scan signals overlap with each another by one horizontal cycle, the scan driving circuit is configured to be driven by the first and second clock signals and the first and second inverted clock signals, each of the n stages comprises a clock terminal, an inverted clock terminal, an input terminal, and an output terminal, wherein:

the clock terminal and inverted clock terminal of a $(4a+1)^{th}$ stage are configured to be, respectively, supplied with the first clock signal and the first inverted clock signal, where a denotes an integer equal to or greater than "0" and less than "n/4,"

the clock terminal and inverted clock terminal of a $(4a+2)^{th}$ stage are configured to be, respectively, supplied with the second clock signal and the second inverted clock signal, the clock terminal and inverted clock terminal of a $(4a+3)^{th}$ stage are configured to be, respectively, supplied with the first inverted clock signal and the first clock signal, the clock terminal and inverted clock terminal of a $(4a+4)^{th}$ stage are configured to be, respectively, supplied with the second inverted clock signal and the second clock signal, the input terminals of the first and second stages are configured to be supplied with a start pulse signal, and the input terminal of each of the third to $n^{th}$ stages is coupled to the output terminal of a stage two stages prior.

11. The scan driving circuit of claim 1, wherein the scan signals overlap with each another by two horizontal cycles, the scan driving circuit is configured to be driven by the first to third clock signals and the first to third inverted clock signals, each of the n stages comprises a clock terminal, an inverted clock terminal, an input terminal, and an output terminal, wherein:

the clock terminal and inverted clock terminal of a $(6b+1)^{th}$ stage are configured to be, respectively, supplied with the first clock signal and the first inverted clock signal, where b denotes an integer equal to or greater than "0" and less than "n/6,"

the clock terminal and inverted clock terminal of a $(6b+2)^{th}$ stage are configured to be, respectively, supplied with the second clock signal and the second inverted clock signal, the clock terminal and inverted clock terminal of a $(6b+3)^{th}$ stage are configured to be, respectively, supplied with the third clock signal and the third inverted clock signal, the clock terminal and inverted clock terminal of a $(6b+4)^{th}$ stage are configured to be, respectively, supplied with the first inverted clock signal and the first clock signal, the clock terminal and inverted clock terminal of the $(6b+5)^{th}$ stage are configured to be, respectively, supplied with the second inverted clock signal and the second clock signal, the clock terminal and inverted clock terminal of a $(6b+6)^{th}$ stage are configured to be, respectively, supplied with the third inverted clock signal and the third clock signal, the input terminals of the first to third stages are configured to be supplied with a start pulse signal, and the input terminal of each of the fourth to $n^{th}$ stages is coupled to an output terminal of a stage three stages prior.

12. The scan driving circuit of claim 1, wherein the display apparatus is an organic electro-luminescent display device.

13. The scan driving circuit of claim 1, wherein the scan signals are activated for (h+1) horizontal cycles.

14. A display apparatus comprising:

a plurality of pixels arranged at crossing regions of data lines and scan lines;

a scan driver for supplying scan signals to the plurality of pixels via the scan lines, respectively; and a data driver for generating a data signal corresponding to an image, and supplying the data signal to the plurality of pixels via the data lines, respectively, wherein the scan driver comprises a scan driving circuit of claim 1.

15. A display apparatus comprising:

a plurality of pixels arranged at crossing regions of data lines and scan lines;

a scan driver for supplying scan signals to the plurality of pixels via the scan lines, respectively; and a data driver for generating a data signal corresponding to an image, and supplying the data signal to the plurality of pixels via the data lines, respectively, wherein the scan driver comprises a scan driving circuit of claim 2.

16. A display apparatus comprising:

a plurality of pixels arranged at crossing regions of data lines and scan lines;

a scan driver for supplying scan signals to the plurality of pixels via the scan lines, respectively; and a data driver for generating a data signal corresponding to an image, and supplying the data signal to the plurality of pixels via the data lines, respectively, wherein the scan driver comprises a scan driving circuit of claim 5.

17. A display apparatus comprising:

a plurality of pixels arranged at crossing regions of data lines and scan lines;

a scan driver for supplying scan signals to the plurality of pixels via the scan lines, respectively; and a data driver for generating a data signal corresponding to an image, and supplying the data signal to the plurality of pixels via the data lines, respectively, wherein the scan driver comprises a scan driving circuit of claim 9.

* * * * *